US010107252B2

(12) United States Patent
Ban et al.

(10) Patent No.: US 10,107,252 B2
(45) Date of Patent: Oct. 23, 2018

(54) IGNITION PLUG AND IGNITION DEVICE

(71) Applicant: NGK Spark Plug Co., LTD., Nagoya (JP)

(72) Inventors: Kenji Ban, Gifu (JP); Kohei Usami, Nagoya (JP)

(73) Assignee: NGK Spark Plug Co., LTD., Nagoya (JP)

( * ) Notice: Subject to any disclaimer, the term of this patent is extended or adjusted under 35 U.S.C. 154(b) by 326 days.

(21) Appl. No.: 15/168,801

(22) Filed: May 31, 2016

(65) Prior Publication Data

US 2016/0369764 A1 Dec. 22, 2016

(30) Foreign Application Priority Data

Jun. 19, 2015 (JP) ..... 2015-123360

(51) Int. Cl.

| | |
|---|---|
| ***H01T 13/20*** | (2006.01) |
| ***F02P 9/00*** | (2006.01) |
| ***H01T 13/52*** | (2006.01) |
| ***F02P 23/04*** | (2006.01) |
| *H01T 13/16* | (2006.01) |

(52) U.S. Cl.

CPC ..... *F02P 9/007* (2013.01); *F02P 23/04* (2013.01); *H01T 13/52* (2013.01); *H01T 13/16* (2013.01)

(58) Field of Classification Search

USPC ..... 313/137, 143

See application file for complete search history.

(56) References Cited

U.S. PATENT DOCUMENTS

| | | | | |
|---|---|---|---|---|
| 4,841,925 | A * | 6/1989 | Ward | F02P 3/0884 123/143 B |
| 2013/0088140 | A1* | 4/2013 | Kameda | F02P 9/007 313/143 |
| 2013/0328477 | A1* | 12/2013 | Katsuraya | H01T 13/20 313/145 |
| 2014/0174416 | A1 | 6/2014 | Okabe et al. | |
| 2016/0204580 | A1* | 7/2016 | Yoshida | H01T 13/39 313/141 |
| 2016/0369764 | A1* | 12/2016 | Ban | F02P 9/007 |

FOREIGN PATENT DOCUMENTS

| | | | |
|---|---|---|---|
| JP | 2014-123435 | A | 7/2014 |

* cited by examiner

*Primary Examiner* — Ronald W Leja
(74) *Attorney, Agent, or Firm* — Leason Ellis LLP

(57) ABSTRACT

In an ignition plug, the volume V1 of a portion of an insulator, which projects from a metallic shell to a front side, is equal to or greater than 45 $mm^3$; and an expression $0.18 \leq V2/V1 \leq 0.37$ is satisfied, where H is a length along which the insulator projects from the metallic shell to the front side in an axial direction, and V2 is a volume of a portion of the insulator, which projects from a front end of the insulator along a length H/2 in the axial direction.

6 Claims, 7 Drawing Sheets

| SAMPLE | VOLUME V1 [mm³] | VOLUME V2 [mm³] | VOLUME RATIO V2/V1 | TIP PORTION OUTER DIAMETER D [mm] | BASE PORTION OUTER DIAMETER Y [mm] | PROJECTING LENGTH H [mm] | FRONT END LENGTH L [mm] | AXIS DIAMETER Dc [mm] | AXIAL TIP LENGTH Lc [mm] | METALLIC SHELL NOMINAL DIAMETER | DIAMETER DIFFERENCE X-Y [mm] | HEAT RESISTANCE EVALUATION | ANTI-FOULING EVALUATION |
|---|---|---|---|---|---|---|---|---|---|---|---|---|---|
| S1 | 195.0 | 29.4 | 0.15 | 3.2 | 7.4 | 9.7 | 5.7 | 1.7 | 8.4 | M14 | 1.0 | POOR | GOOD |
| S2 | 204.0 | 36.9 | 0.18 | 3.5 | 7.4 | 9.7 | 5.7 | 1.7 | 8.4 | M14 | 0.5 | EXCELLENT | GOOD |
| S3 | 204.0 | 36.9 | 0.18 | 3.5 | 7.4 | 9.7 | 5.7 | 1.7 | 8.4 | M14 | 1.0 | EXCELLENT | GOOD |
| S4 | 204.0 | 36.9 | 0.18 | 3.5 | 7.4 | 9.7 | 5.7 | 1.7 | 8.4 | M14 | 2.0 | GOOD | GOOD |
| S5 | 224.4 | 54.0 | 0.24 | 4.1 | 7.4 | 9.7 | 5.7 | 1.7 | 8.4 | M14 | 1.0 | EXCELLENT | GOOD |
| S6 | 346.0 | 88.5 | 0.26 | 4.1 | 7.4 | 12.7 | 5.7 | 1.7 | 11.4 | M14 | 1.0 | EXCELLENT | GOOD |
| S7 | 83.8 | 23.3 | 0.28 | 3.3 | 5.7 | 6.0 | 3.5 | 1.7 | 4.0 | M12 | 1.0 | EXCELLENT | GOOD |
| S8 | 93.6 | 27.0 | 0.29 | 3.3 | 5.7 | 8.0 | 5.5 | 1.7 | 7.0 | M12 | 1.0 | EXCELLENT | GOOD |
| S9 | 102.6 | 37.9 | 0.37 | 4.1 | 7.4 | 6.7 | 5.7 | 1.7 | 5.4 | M14 | 0.5 | EXCELLENT | GOOD |
| S10 | 102.6 | 37.9 | 0.37 | 4.1 | 7.4 | 6.7 | 5.7 | 1.7 | 5.4 | M14 | 1.0 | EXCELLENT | GOOD |
| S11 | 102.6 | 37.9 | 0.37 | 4.1 | 7.4 | 6.7 | 5.7 | 1.7 | 5.4 | M14 | 2.0 | GOOD | GOOD |
| S12 | 134.9 | 54.0 | 0.40 | 4.1 | 7.4 | 9.7 | 5.7 | 1.7 | 8.4 | M14 | 1.0 | EXCELLENT | POOR |

FIG. 4

| SAMPLE | VOLUME RATIO V2/V1 | RATIO D/L | PROJECTING LENGTH H [mm] | DIAMETER DIFFERENCE X-Y [mm] | VIBRATION RESISTANCE EVALUATION |
|---|---|---|---|---|---|
| S2 | 0.18 | 0.61 | 9.7 | 0.5 | EXCELLENT |
| S3 | 0.18 | 0.61 | 9.7 | 1.0 | EXCELLENT |
| S5 | 0.24 | 0.72 | 9.7 | 1.0 | EXCELLENT |
| S6 | 0.26 | 0.72 | 12.7 | 1.0 | GOOD |
| S7 | 0.28 | 0.58 | 6.0 | 1.0 | EXCELLENT |
| S8 | 0.29 | 0.58 | 8.0 | 1.0 | EXCELLENT |
| S9 | 0.37 | 1.17 | 6.7 | 0.5 | GOOD |
| S10 | 0.37 | 0.75 | 6.7 | 1.0 | EXCELLENT |

FIG. 5

IGNITION PLUG AND IGNITION DEVICE

This application claims the benefit of Japanese Patent Application No. 2015-123360, filed Jun. 19, 2015, which is incorporated herein by reference in its entity.

FIELD OF THE INVENTION

The present invention relates to an ignition plug and an ignition device.

BACKGROUND OF THE INVENTION

As an ignition device that ignites an air-fuel mixture in a combustion chamber of an internal combustion engine, an ignition device is known which ignites by using non-equilibrium plasma (see, e.g., Japanese Patent Application Laid-Open (kokai) No. 2014-123435). Such an ignition device includes an ignition plug having an insulator enclosing a center electrode, and generates non-equilibrium plasma on the surface of the insulator by applying an AC voltage to the center electrode or applying a pulse voltage a plurality of times to the center electrode.

Problems to be Solved by the Invention

In the ignition device disclosed in Japanese Patent Application Laid-Open (kokai) No. 2014-123435, from the standpoint of improving ignitability by increasing the amount of generated non-equilibrium plasma, it is effective that the insulator of the ignition plug projects longer into the combustion chamber. However, as the insulator of the ignition plug projects longer into the combustion chamber, the insulator is more easily heated by combustion heat. When the temperature of the insulator excessively increases, the air-fuel mixture is ignited by the heat of the insulator, so that pre-ignition occurs in which the air-fuel mixture is ignited earlier than intended combustion timing. Pre-ignition causes a damage to the internal combustion engine.

SUMMARY OF THE INVENTION

Means for Solving the Problems

The present invention has been made to solve the above-described problem, and can be embodied in the following modes.

(1) According to an aspect of the present invention, an ignition plug is provided which includes: a center electrode extending from a front side to a rear side in an axial direction; an insulator formed in a bottomed tubular shape and enclosing a front end of the center electrode; and a metallic shell formed in a tubular shape extending in the axial direction and holding the insulator in a state where the insulator projects to the front side. In the ignition plug, a volume V1 of a portion of the insulator, which projects from the metallic shell to the front side, is equal to or greater than 45 $mm^3$; and an expression $0.18 \leq V2/V1 \leq 0.37$ is satisfied, where H is a length along which the insulator projects from the metallic shell to the front side in the axial direction, and V2 is a volume of another portion of the insulator, which projects from a front end of the insulator along a length H/2 in the axial direction. According to this aspect, by meeting $0.18 \leq V2/V1$, sufficient heat conduction from the front end of the insulator can be ensured, so that occurrence of pre-ignition due to heat of the insulator can be prevented. In addition, by meeting $V2/V1 \leq 0.37$, the temperature of the insulator can be maintained to such a degree that accumulation of carbon can be prevented, so that a decrease in the amount of generated non-equilibrium plasma caused by accumulation of carbon on the insulator can be prevented. Because of these results, ignitability can be improved while pre-ignition is prevented.

(2) In the ignition plug of the above aspect, an expression $0\ mm < X - Y \leq 1.0\ mm$ is satisfied, where X is an inner diameter of a front hole of the metallic shell and Y is an outer diameter of a part of the insulator which opposes the front hole. According to this aspect, heat conduction from the insulator through the metallic shell can be improved. Therefore, occurrence of pre-ignition due to heat of the insulator can be prevented further.

(3) In the ignition plug of the above aspect, the length H may be equal to or less than 9.7 mm, the insulator may include: a first outer diameter portion projecting from the metallic shell and having a first outer diameter; and a second outer diameter portion having a second outer diameter D smaller than the first outer diameter and forming the front side of the insulator with respect to the first outer diameter portion, and an expression $D/L \leq 0.75$ is satisfied, where L is a length of the second outer diameter portion in the axial direction. According to this aspect, damage of the insulator caused by vibration can be prevented. In other words, the vibration resistance of the insulator can be improved.

(4) In the ignition plug of the above aspect, the center electrode may include a portion having an outer diameter that is larger than the rear side of the center electrode in a range from the front end of the insulator to the length H/2 in the axial direction. According to this aspect, the amount of generated non-equilibrium plasma can be increased at the front side of the insulator.

(5) In the ignition plug of the above aspect, the insulator may include a portion in which an outer diameter thereof decreases toward the front side in a range from the front end of the insulator to the length H/2 in the axial direction. According to this aspect, the vibration resistance of the insulator can be improved.

(6) According to an aspect of the present invention, an ignition device is provided. The ignition device includes: an ignition plug of the above aspect; and a voltage application part that is configured to generate non-equilibrium plasma on a surface of the insulator by applying an AC voltage or multiple pulse voltages to the center electrode. According to this aspect, ignitability by non-equilibrium plasma can be improved while pre-ignition is prevented.

The present invention can be embodied in various forms other than the ignition plug and the ignition device. For example, the present invention can be embodied in forms such as a component of an ignition plug and an ignition method.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 4 is a table showing results of evaluation of heat resistance and anti-fouling characteristics of ignition plugs.

FIG. 5 is a table showing results of evaluation of vibration resistance of the ignition plugs.

DETAILED DESCRIPTION OF THE INVENTION

Modes for Carrying Out the Invention

A. First Embodiment

A1. Configuration of Ignition Device

Figure 1:
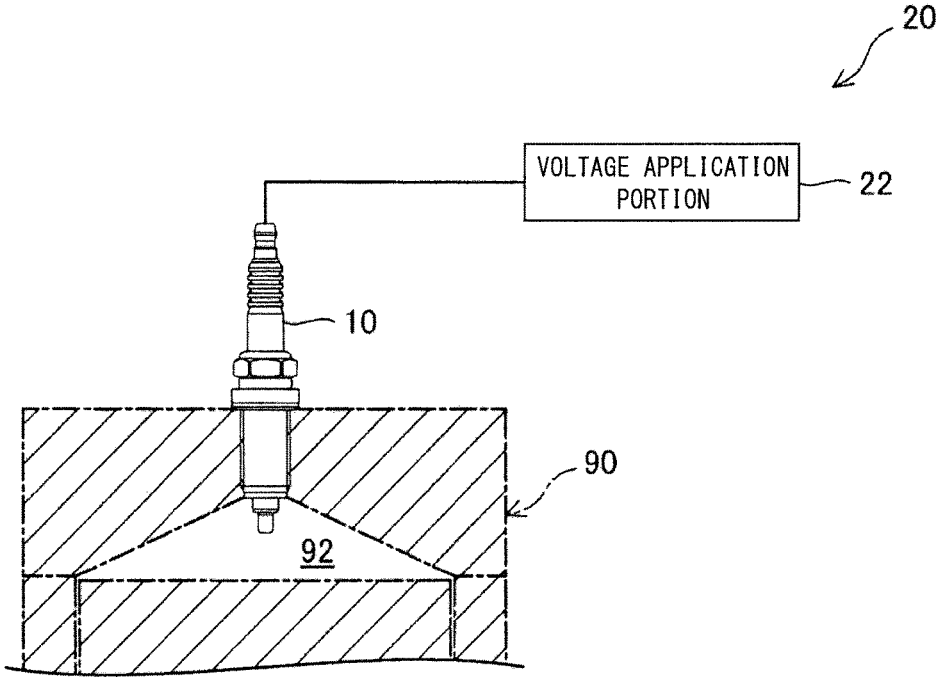
FIG. 1 is an explanatory diagram showing the configuration of an ignition device.

FIG. 1 is an explanatory diagram showing the configuration of an ignition device 20. The ignition device 20 is a device that ignites an air-fuel mixture in a combustion chamber 92 of an internal combustion engine 90. The ignition device 20 includes an ignition plug 10 and a voltage application portion 22.

The ignition plug 10 of the ignition device 20 is mounted on the internal combustion engine 90. A front end of the ignition plug 10 is exposed inside the combustion chamber 92. A rear end of the ignition plug 10 is electrically connected to the voltage application portion 22. The ignition plug 10 will be described in detail later.

The voltage application portion 22 of the ignition device 20 applies an AC voltage to the ignition plug 10 or applies a pulse voltage a plurality of times to the ignition plug 10. Accordingly, non-equilibrium plasma occurs at the front end of the ignition plug 10. By the non-equilibrium plasma, an air-fuel mixture in the combustion chamber 92 is ignited. In the present embodiment, the voltage application portion 22 applies the voltage to the ignition plug 10 by using power supplied from a lead storage battery.

A2. Configuration of Ignition Plug

Figure 2:
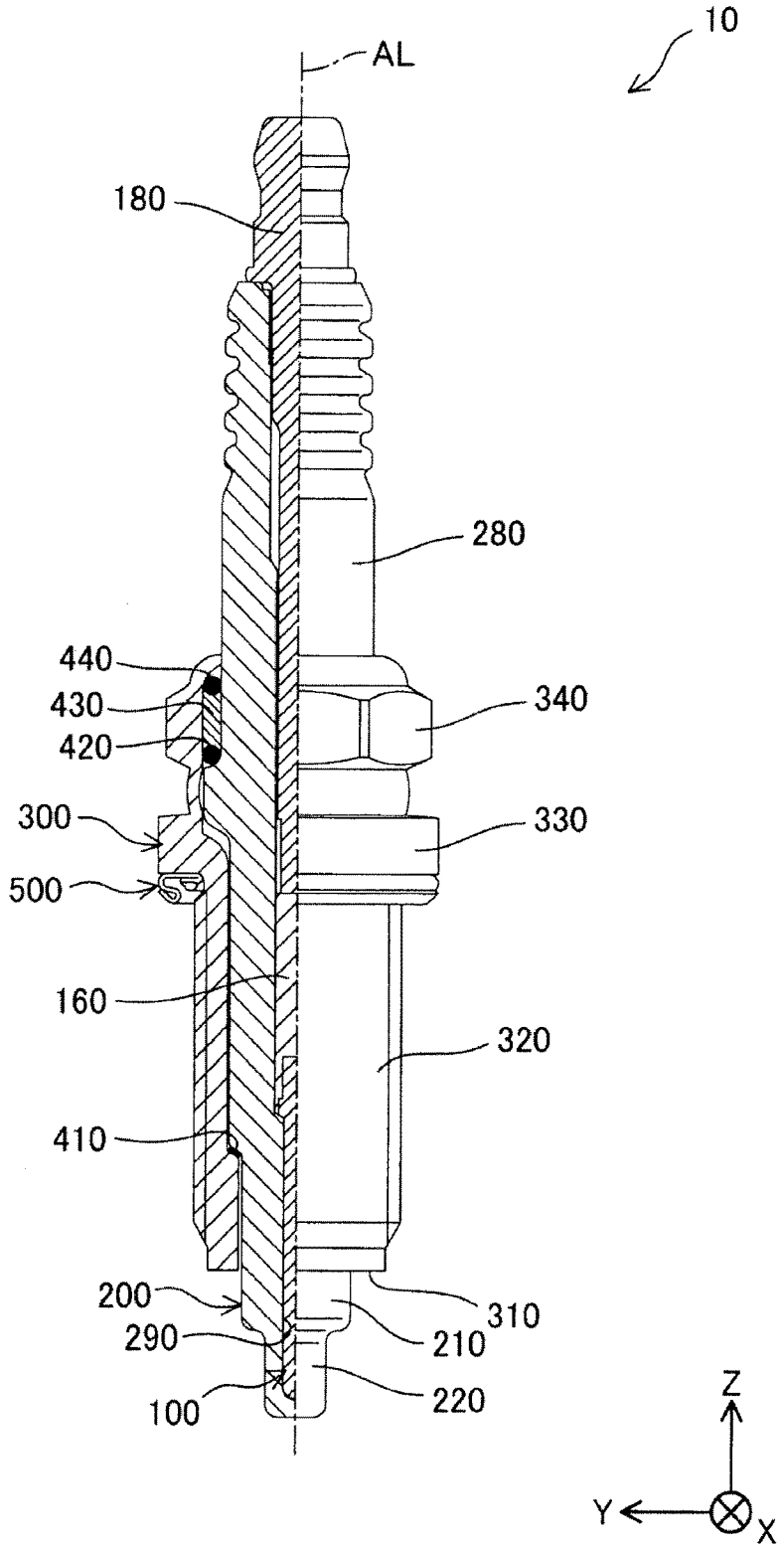
FIG. 2 is an explanatory diagram showing the configuration of an ignition plug.

FIG. 2 is an explanatory diagram showing the configuration of the ignition plug 10. In FIG. 2, with an axial line AL of the ignition plug 10 as a boundary, the external appearance shape of the ignition plug 10 is shown at the right side of the sheet, and a cross-sectional shape of the ignition plug 10 is shown at the left side of the sheet. In the description of the present embodiment, the lower side of the ignition plug 10 in the sheet of FIG. 2 is referred to as "front side", and the upper side of the ignition plug 10 in the sheet of FIG. 2 is referred to as "rear side".

FIG. 2 shows X, Y, and Z axes. The X, Y, and Z axes in FIG. 2 include an X axis, a Y axis, and a Z axis as three space axes orthogonal to each other. In the present embodiment, the Z axis is an axis along the axial line AL of the ignition plug 10. In the X axis direction along the X axis, a +X axis direction is the direction from the near side of the sheet toward the far side of the sheet, and a −X axis direction is the direction opposite to the +X axis direction. In the Y axis direction along the Y axis, a +Y axis direction is the direction from the right side of the sheet toward the left side of the sheet, and a −Y axis direction is the direction opposite to the +Y axis direction. In the Z axis direction (axial direction) along the Z axis, a +Z axis direction is the direction from the front side toward the rear side, and a −Z axis direction is the direction opposite to the +Z axis direction. The X, Y, and Z axes in FIG. 2 correspond to X, Y, and Z axes in other drawings.

The ignition plug 10 includes a center electrode 100, an insulator 200, and a metallic shell 300. In the present embodiment, the axial line AL of the ignition plug 10 is also the axial line of each component such as the center electrode 100, the insulator 200, and the metallic shell 300.

The center electrode 100 of the ignition plug 10 is a member having electrical conductivity. In the present embodiment, the center electrode 100 is mainly composed of a nickel alloy containing nickel (Ni) as a principal component (e.g., INCONEL 600 ("INCONEL" is a registered trademark). The center electrode 100 is formed in a shape extending from the front side to the rear side in the axial direction. In the present embodiment, the center electrode 100 is formed in a rod shape extending with the axial line AL as a center.

The center electrode 100 is provided inside the insulator 200. In the present embodiment, the center electrode 100 is electrically connected to the rear side of the insulator 200 via a sealing material 160 and a terminal 180. The sealing material 160 is a conductor that is provided inside the insulator 200 and connects between the center electrode 100 and the terminal 180. The terminal 180 is a conductor that projects from the insulator 200 to the rear side and is connected to the voltage application portion 22. The center electrode 100 receives the voltage applied from the voltage application portion 22, via the sealing material 160 and the terminal 180.

The insulator 200 of the ignition plug 10 is a member having an electrical insulation property. In the present embodiment, the insulator 200 is formed from a ceramic material obtained by sintering an insulating material (e.g., alumina). The insulator 200 is formed in a bottomed tubular shape having a bottom at the front side. The insulator 200 encloses the front end of the center electrode 100. In the present embodiment, the insulator 200 has an axial hole 290 extending with the axial line AL as a center. In the present embodiment, the center electrode 100, the sealing material 160, and the terminal 180 are provided in the axial hole 290 in order from the front side.

The metallic shell 300 of the ignition plug 10 is a member having electrical conductivity. In the present embodiment, the metallic shell 300 is mainly composed of low-carbon steel. The metallic shell 300 is formed in a tubular shape extending in the axial direction. The metallic shell 300 holds the insulator 200 in a state where the insulator 200 projects to the front side. In the present embodiment, the metallic shell 300 holds the front side of the insulator 200 via a packing 410. In the present embodiment, the metallic shell 300 holds the rear side of the insulator 200 via talc powder 430 packed between a ring 420 and a ring 440. In the present embodiment, the metallic shell 300 includes a front end portion 310, an external thread portion 320, a trunk portion 330, and a tool engagement portion 340.

The front end portion 310 of the metallic shell 300 forms the front end of the metallic shell 300. In the present embodiment, the front end portion 310 is a flat surface that extends along the X axis and the Y axis and faces in the −Z axis direction. In the present embodiment, the front end portion 310 is a flat surface having a hollow circular shape. The insulator 200 projects from the center of the front end portion 310 to the front side.

The external thread portion 320 of the metallic shell 300 is a cylindrical portion that is formed at the rear side with respect to the front end portion 310 and has an external thread on the outer circumference thereof. The external thread portion 320 is fitted to an internal thread (not shown) formed in the internal combustion engine 90, whereby the ignition plug 10 is fixed to the internal combustion engine 90. In the present embodiment, the nominal diameter of the external thread portion 320 is M14. In another embodiment, the nominal diameter of the external thread portion 320 may be smaller than M14 (e.g., M10, M12) or may be larger than M14.

The trunk portion 330 of the metallic shell 300 is a portion that is formed at the rear side with respect to the external thread portion 320 and projects radially outward of the external thread portion 320. In a state where the ignition plug 10 is mounted on the internal combustion engine 90, the trunk portion 330 presses a gasket 500 against the internal combustion engine 90.

The tool engagement portion 340 of the metallic shell 300 is a portion that is formed at the rear side with respect to the trunk portion 330 and projects radially outward in a polygonal shape. The tool engagement portion 340 is formed in a shape that allows the tool engagement portion 340 to be engaged with a tool (not shown) for mounting the ignition plug 10 to the internal combustion engine 90. In the present embodiment, the outer peripheral shape of the tool engagement portion 340 is a hexagon.

Figure 3:
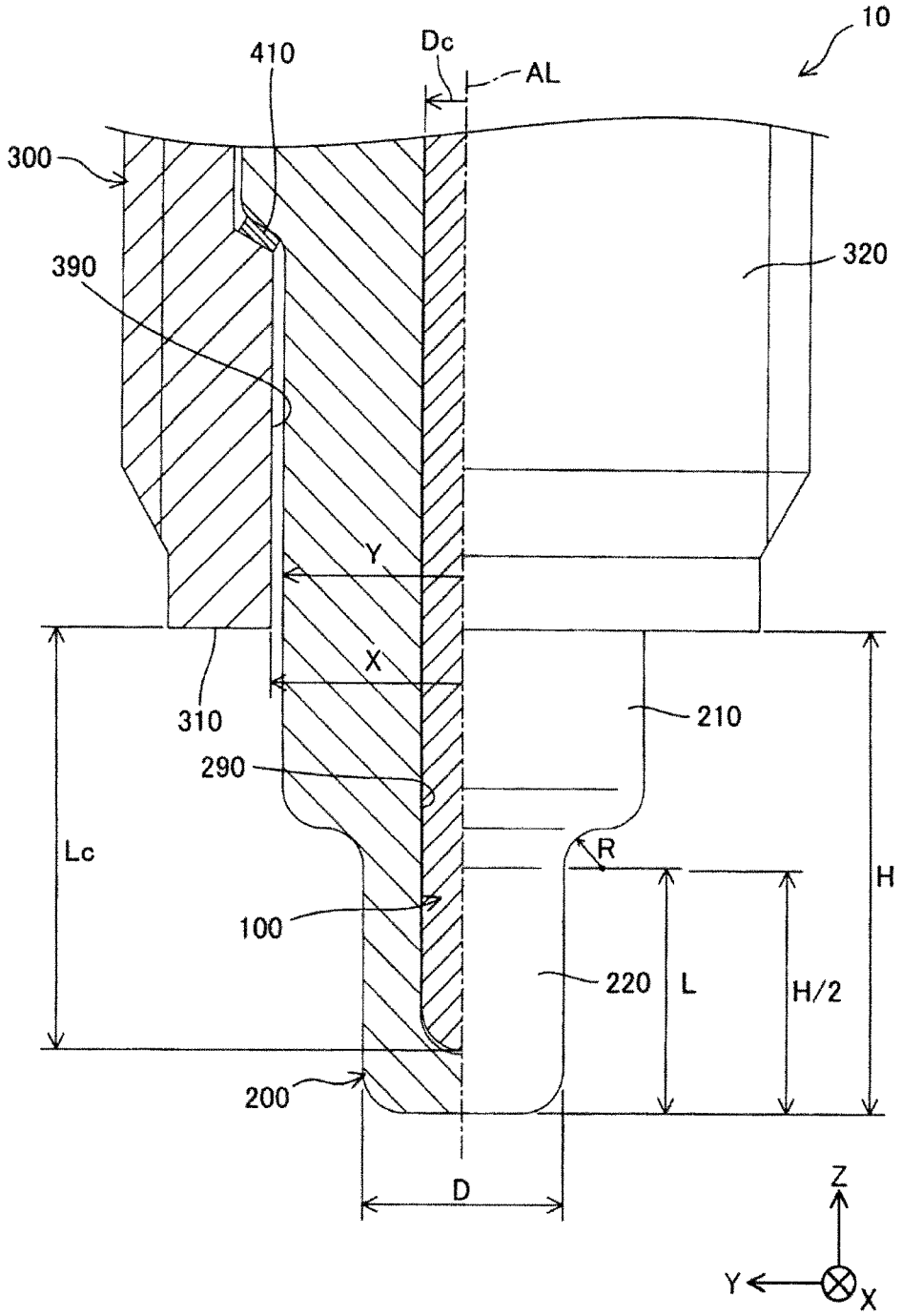
FIG. 3 is an explanatory diagram showing the detailed configuration of the ignition plug.

FIG. 3 is an explanatory diagram showing the detailed configuration of the ignition plug 10. FIG. 3 shows the detailed configuration at the front side of the ignition plug 10.

A length H shown in FIG. 3 is the length by which the insulator 200 projects from the metallic shell 300 to the front side in the axial direction. From the standpoint of increasing the amount of generated non-equilibrium plasma, the volume V1 of a portion of the insulator 200 which portion projects from the metallic shell 300 to the front side is preferably equal to or greater than 45 $mm^3$.

From the standpoint of preventing occurrence of pre-ignition due to heat of the insulator 200, the volume V2 of a portion of the insulator 200 which portion extends from the front end of the insulator 200 to a length H/2 in the axial direction preferably meets $0.18 \leq V2/V1$. In addition, from the standpoint of preventing a decrease in the amount of generated non-equilibrium plasma caused by accumulation of carbon on the insulator 200, the volume V2 preferably meets $V2/V1 \leq 0.37$.

An inner diameter X shown in FIG. 3 is the inner diameter of a front hole 390 of the metallic shell 300. An outer diameter Y shown in FIG. 3 is the outer diameter of a portion of the insulator 200 which portion opposes the front hole 390. From the standpoint of improving heat conduction from the insulator 200 through the metallic shell 300, the diameter difference (X−Y) is preferably greater than 0 mm and equal to or less than 1.0 mm.

In the present embodiment, the insulator 200 includes a base portion 210 and a tip portion 220, as a projection portion projecting from the metallic shell 300. The base portion 210 of the insulator 200 is a first outer diameter portion having the outer diameter Y. The tip portion 220 of the insulator 200 is a second outer diameter portion that has an outer diameter D smaller than the outer diameter Y and forms the front side with respect to the base portion 210. A length L in FIG. 3 is the length of the tip portion 220 in the axial direction, and is a length to a curved surface R leading to the base portion 210. From the standpoint of preventing damage of the insulator 200 caused by vibration, the length H is preferably equal to or less than 9.7 mm, and the ratio D/L is preferably equal to or less than 0.75.

Dc shown in FIG. 3 represents the axis diameter of the center electrode 100. A length Lc shown in FIG. 3 is the length by which the center electrode 100 projects from the metallic shell 300 to the front side in the axial direction.

A3. Evaluation Test

FIG. 4 is a table showing results of evaluation of heat resistance and anti-fouling characteristics of ignition plugs. In an evaluation test of FIG. 4, an examiner prepared samples S1 to S12 that are a plurality of ignition plugs having specifications different from each other. Each of the samples S1 to S12 is the same as the ignition plug 10 except that the dimension of each portion is different. Items shown as the specifications of each sample in FIG. 4 correspond to items of the same reference characters described for the ignition plug 10. The "metallic shell nominal diameter" of each sample is the nominal diameter of the external thread formed on the external thread portion of the metallic shell.

The examiner evaluated heat resistance for each sample. In the heat resistance evaluation, the examiner mounted each sample to a four-cylinder DOHC engine having a displacement of 1.6 L, and then operated the engine for 2 minutes at each ignition timing while advancing ignition timing from standard ignition timing in steps of a predetermined angle. While the engine was operated, the examiner checked presence/absence of pre-ignition on the basis of the waveform of a current applied to each sample. The sample with which pre-ignition occurs at an greater advance is an ignition plug with which pre-ignition is less likely to occur, that is, an ignition plug having excellent heat resistance.

The examiner evaluates heat resistance of each sample on the basis of the following evaluation criteria.

<Evaluation Criteria for Heat Resistance>

Excellent: No pre-ignition occurred until an advance of +4°.

Good: No pre-ignition occurred until an advance of +2°.

Poor: Pre-ignition occurred before an advance of +2°.

Regarding the sample S1 in which the volume ratio V2/V1 is less than 0.18, pre-ignition occurred at an advance of +2°, so that it was found that the heat resistance is insufficient. This result is thought to be caused because the volume V2 of the front side of the insulator 200 is excessively small in a relation between the volume V1 and combustion heat, so that the front side of the insulator 200 was excessively heated.

Regarding the samples S2 to S12 in which the volume ratio V2/V1 is equal to or greater than 0.18, no pre-ignition occurred until an advance of +2°, and with some of the samples S2 to S12, no pre-ignition occurred until an advance of +4°, so that it was found that sufficient heat resistance can be ensured. This result is thought to be caused because the volume V2 of the front side of the insulator 200 is ensured appropriately in a relation between the volume V1 and combustion heat, so that heat was able to be effectively released to the rear side before the front side of the insulator 200 was excessively heated.

Among the samples S2 to S12 in which the volume ratio V2/V1 is equal to or greater than 0.18, regarding the samples S2, S3, S5 to S10, and S12 in which the diameter difference (X−Y) is equal to or less than 1.0 mm, no pre-ignition occurred until an advance of +4°, so that it was found that sufficient heat resistance can be ensured. This result is thought to be caused because the gap between the insulator 200 and the metallic shell 300 is narrower than that in the samples S4 and S11, so that heat was able to be effectively released from the insulator 200 to the metallic shell 300.

In addition to the heat resistance evaluation, the examiner evaluated anti-fouling characteristics for each sample. In the anti-fouling characteristics evaluation, the examiner places a vehicle equipped with a four-cylinder DOHC engine having a displacement of 1.6 L, on a chassis dynamometer installed in a low-temperature testing room at −10° C., and mounted each sample to the engine. Thereafter, the examiner repeated 10 cycles of an operation pattern having the following series of operation patterns as one cycle <Operation Pattern>

Operation 1: Racing was performed three times, and then the vehicle was run at third gear and at a speed of 35 km/hour for 40 seconds. Then, after idling for 90 seconds, the vehicle was run at third gear and at a speed of 35 km/hour for 40 seconds again. Thereafter, the engine was stopped and cooled.

Operation 2: After operation 1, a cycle of performing racing three times and running the vehicle at first gear and at a speed of 15 km/hour for 20 seconds was performed three times in total with idling for 30 seconds between the cycles. Thereafter, the engine was stopped and cooled.

The examiner evaluated anti-fouling characteristics of each sample on the basis of the following evaluation criteria.

<Evaluation Criteria for Anti-Fouling Characteristics>

Good: 10 cycles of operation was achieved without occurrence of misfire of the engine.

Poor: Misfire of the engine occurred before 10 cycles of operation was achieved.

Regarding the sample S12 in which the volume ratio V2/V1 exceeds 0.37, misfire of the engine occurred before 10 cycles of operation was achieved, so that it was found that the anti-fouling characteristics are insufficient. This result is thought to be caused because the volume V2 of the front side of the insulator 200 is excessively large in a relation between the volume V1 and combustion heat, so that the front side of the insulator 200 was not sufficiently heated. If the front side of the insulator 200 is not sufficiently heated, carbon accumulates on the surface of the insulator 200, so that the amount of generated non-equilibrium plasma on the surface of the insulator 200 decreases. As a result, misfire of the engine is likely to occur.

Regarding the samples S1 to S11 in which the volume ratio V2/V1 is equal to or less than 0.37, 10 cycles of operation was able to be achieved without occurrence of misfire of the engine, so that it was found that sufficient anti-fouling characteristics can be ensured. This result is thought to be caused because the volume V2 of the front side of the insulator 200 is ensured appropriately in a relation between the volume V1 and combustion heat, so that the front side of the insulator 200 was heated sufficiently to such a degree that carbon attached to the surface of the insulator 200 can be burn off. Regarding the anti-fouling characteristics, no influence of the diameter difference (X−Y) was observed.

FIG. 5 is a table showing results of evaluation of vibration resistance of the ignition plugs. In an evaluation test of FIG. 5, the examiner evaluated vibration resistance for the samples S2, S3, S5 to S10, and S12 having excellent heat resistance, among the samples S1 to S12 used in the evaluation test of FIG. 4. In the vibration resistance evaluation, the examiner repeatedly applied a force that was changed periodically at 15 Hz with a shift from 50 N via 300 N back to 50 N as one cycle, to a position on each sample away from the front end of the insulator in the axial direction by 1 mm.

The examiner evaluated vibration resistance of each sample on the basis of the following evaluation criteria.

<Evaluation Criteria for Vibration Resistance>

Excellent: The cycles reached 150 thousand cycles without occurrence of breakage of the insulator.

Good: Breakage of the insulator occurred when the cycles were not less than 100 thousand cycles and less than 150 thousand cycles.

Poor: Breakage of the insulator occurred when the cycles were less than 100 thousand cycles.

According to the results of the vibration resistance evaluation, regarding the samples S2, S3, S5, S7, S8, and S10 in which the length H is equal to or less than 9.7 mm and the ratio D/L is equal to or less than 0.75, the cycles reached 150 thousand cycles without occurrence of breakage of the insulator, so that it was found that sufficient vibration resistance can be ensured.

A4. Advantageous Effects

According to the first embodiment described above, the volume V1 is equal to or greater than 45 $mm^3$ and meets $0.18 \leq V2/V1 \leq 0.37$. By meeting $0.18 \leq V2/V1$, sufficient heat conduction from the front end of the insulator 200 can be ensured, so that occurrence of pre-ignition due to heat of the insulator 200 can be prevented. In addition, by meeting $V2/V1 \leq 0.37$, the temperature of the insulator 200 can be maintained to such a degree that accumulation of carbon can be prevented, so that a decrease in the amount of generated non-equilibrium plasma caused by accumulation of carbon on the insulator 200 can be prevented. Because of these results, ignitability can be improved while pre-ignition is prevented.

By meeting 0 mm<X−Y 1.0 mm, heat conduction from the insulator 200 through the metallic shell 300 can be improved. Therefore, occurrence of pre-ignition due to heat of the insulator 200 can be prevented further.

By the length H being equal to or less than 9.7 mm and meeting $D/L \leq 0.75$, damage of the insulator 200 caused by vibration can be prevented. In other words, the vibration resistance of the insulator 200 can be improved.

B. Second Embodiment

Figure 6:
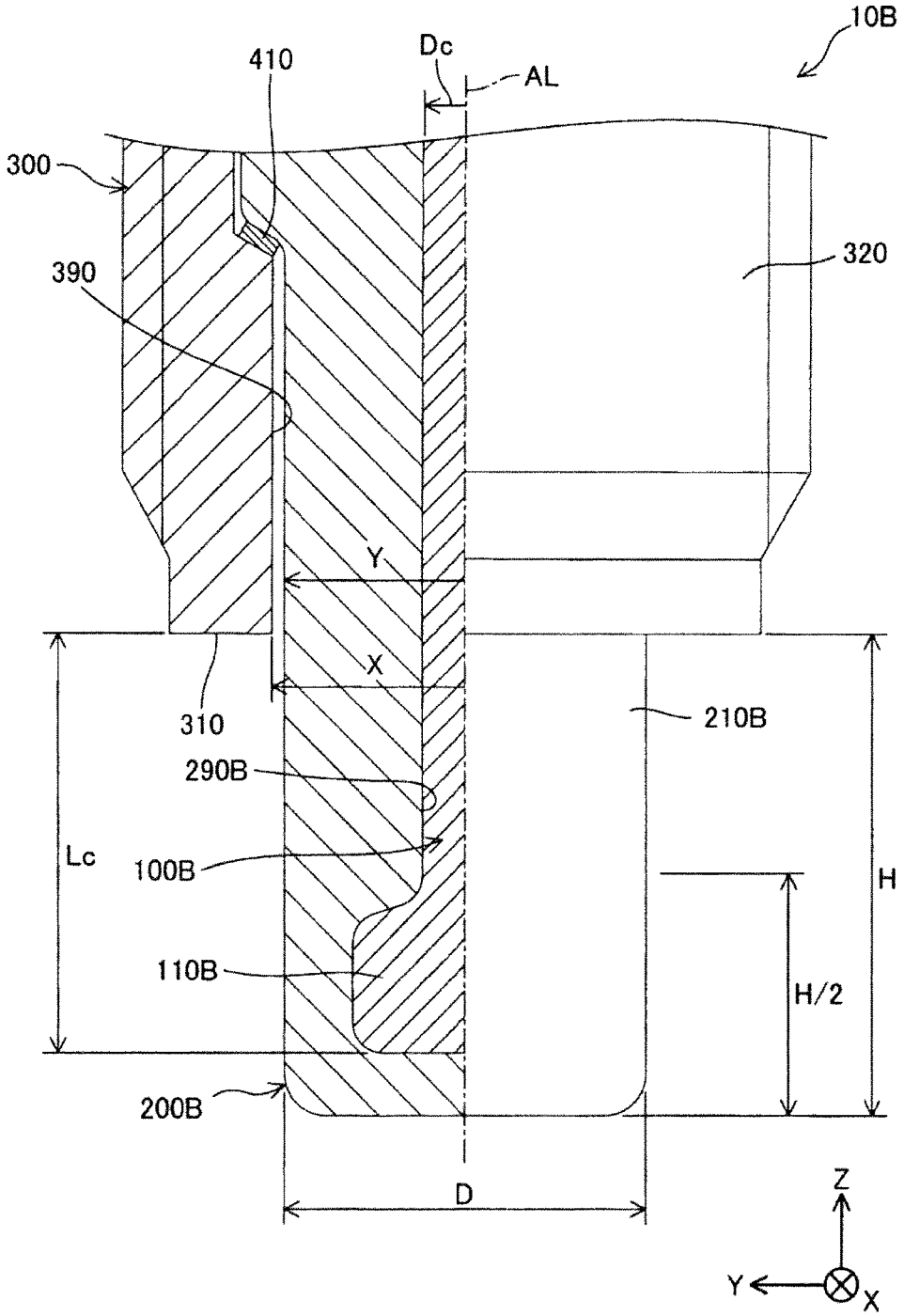
FIG. 6 is an explanatory diagram showing the detailed configuration of an ignition plug according to a second embodiment.

FIG. 6 is an explanatory diagram showing the detailed configuration of an ignition plug 10B according to a second embodiment. FIG. 6 shows the detailed configuration at the front side of the ignition plug 10B. The ignition plug 10B of the second embodiment is the same as the ignition plug 10 of the first embodiment except that: a center electrode 100B is provided instead of the center electrode 100; and an insulator 200B is provided instead of the insulator 200.

The insulator 200B of the ignition plug 10B is the same as the insulator 200 of the first embodiment except that: a projection portion 210B is included instead of the base portion 210 and the tip portion 220; and an axial hole 290B is included instead of the axial hole 290. The projection portion 210B of the insulator 200B is a portion that projects from the metallic shell 300. In the present embodiment, the outer diameter D of the projection portion 210B is equal to the outer diameter Y of a portion of the insulator 200B which portion opposes the front hole 390. The axial hole 290B of the insulator 200B is the same as the axial hole 290 of the first embodiment except that the axial hole 290B is formed in a shape in which the hole diameter thereof is increased at the front side.

The center electrode 100B of the ignition plug 10B is a member having electrical conductivity. The center electrode 100B is provided inside the insulator 200B. In the present embodiment, the center electrode 100B is formed by packing conductive powered into the axial hole 290B of the insulator 200B. The center electrode 100B is formed in a shape extending from the front side to the rear side in the axial direction. In the present embodiment, similarly as in the first embodiment, the center electrode 100B is electrically connected to the rear side of the insulator 200B via the sealing material 160 and the terminal 180.

The center electrode 100B includes, in a range from the front end of the insulator 200B to the length H/2 in the axial direction, a large-diameter portion 110B having an outer diameter larger than the outer diameter Dc of the rear side of the center electrode 100B. Thus, as compared to the case where the outer diameter of the sealing material is uniform also at the front side, the amount of generated non-equilibrium plasma can be increased at the front side of the insulator 200B.

From the standpoint of increasing the amount of generated non-equilibrium plasma, the volume V1 of the projection portion 210B, which is a portion of the insulator 200B projecting from the metallic shell 300 to the front side, is preferably equal to or greater than 45 $mm^3$ similarly as in the first embodiment. From the standpoint of preventing occurrence of pre-ignition due to heat of the insulator 200B, the volume V2 of a portion of the insulator 200B from the front end of the insulator 200B to the length H/2 in the axial direction preferably meets $0.18 \leq V2/V1$ similarly as in the first embodiment. In addition, from the standpoint of preventing a decrease in the amount of generated non-equilibrium plasma caused by accumulation of carbon on the insulator 200B, the volume V2 preferably meets $V2/V1 \leq 0.37$ similarly as in the first embodiment. From the standpoint of improving heat conduction from the insulator 200B through the metallic shell 300, the diameter difference (X−Y) is preferably greater than 0 mm and equal to or less than 1.0 mm similarly as in the first embodiment.

According to the second embodiment described above, similarly to the first embodiment, since the volume V1 is equal to or greater than 45 $mm^3$ and meets $0.18 \leq V2/V1 \leq 0.37$, ignitability can be improved while pre-ignition is prevented. In addition, by meeting $0\ mm < X-Y \leq 1.0\ mm$, occurrence of pre-ignition due to heat of the insulator 200B can be prevented further similarly as in the first embodiment.

C. Third Embodiment

Figure 7:
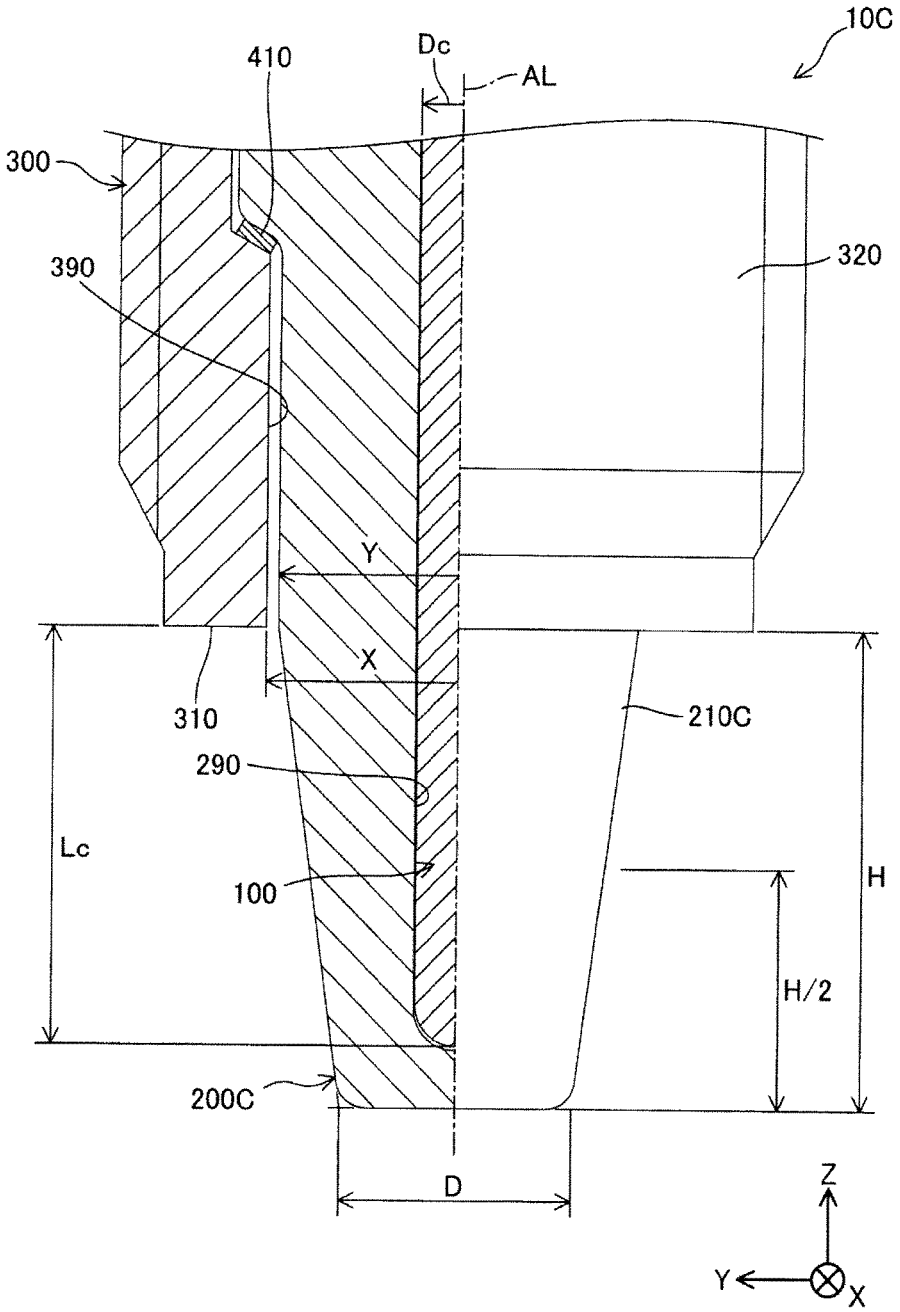
FIG. 7 is an explanatory diagram showing the detailed configuration of an ignition plug according to a third embodiment.

FIG. 7 is an explanatory diagram showing the detailed configuration of an ignition plug 10C according to a third embodiment. FIG. 7 shows the detailed configuration at the front side of the ignition plug 10C. The ignition plug 10C of the third embodiment is the same as the ignition plug 10 of the first embodiment except that an insulator 200C is provided instead of the insulator 200.

The insulator 200C of the ignition plug 100 is the same as the insulator 200 of the first embodiment except that a projection portion 210C is included instead of the base portion 210 and the tip portion 220. The projection portion 210C of the insulator 200C is a portion that projects from the metallic shell 300. The projection portion 210C includes, in a range from the front end of the insulator 200C to the length H/2 in the axial direction, a portion in which the outer diameter thereof decreases toward the front side. In the present embodiment, toward the front side, the outer diameter of the projection portion 210C decreases from the outer diameter Y to the outer diameter D. Thus, the vibration resistance of the insulator 200C can be improved.

From the standpoint of increasing the amount of generated non-equilibrium plasma, the volume V1 of the projection portion 210C, which is a portion of the insulator 200C projecting from the metallic shell 300 to the front side, is preferably equal to or greater than 45 $mm^3$ similarly as in the first embodiment. From the standpoint of preventing occurrence of pre-ignition due to heat of the insulator 200C, the volume V2 of a portion of the insulator 200C from the front end of the insulator 200C to the length H/2 in the axial direction preferably meets $0.18 \leq V2/V1$ similarly as in the first embodiment. In addition, from the standpoint of preventing a decrease in the amount of generated non-equilibrium plasma caused by accumulation of carbon on the insulator 200C, the volume V2 preferably meets $V2/V1 \leq 0.37$ similarly as in the first embodiment. From the standpoint of improving heat conduction from the insulator 200C through the metallic shell 300, the diameter difference (X−Y) is preferably greater than 0 mm and equal to or less than 1.0 mm similarly as in the first embodiment.

According to the third embodiment described above, similarly to the first embodiment, since the volume V1 is equal to or greater than 45 $mm^3$ and meets $0.18 \leq V2/V1 \leq 0.37$, ignitability can be improved while pre-ignition is prevented. In addition, by meeting $0\ mm < X-Y \leq 1.0\ mm$, occurrence of pre-ignition due to heat of the insulator 200C can be prevented further similarly as in the first embodiment.

D. Other Embodiments

The present invention is not limited to the embodiments, examples, and modified embodiments described above, and can be embodied in various configurations without departing from the scope of the present invention. For example, among the technical features in the embodiments, examples, and modified embodiments, the technical features corresponding to the technical features in each aspect described in the Summary of the Invention section can be appropriately replaced or combined to solve part or all of the foregoing problems, or to achieve part or all of the foregoing effects. Further, the technical features that are not described as being essential in the present specification can be appropriately deleted.

DESCRIPTION OF REFERENCE NUMERALS

10, 10B, 10C: ignition plug
20: ignition device
22: voltage application portion
90: internal combustion engine
92: combustion chamber
100, 100B: center electrode
110B: large-diameter portion
160: sealing material
180: terminal
200, 200B, 200C: insulator
210: base portion
210B, 210C: projection portion
220: tip portion
290, 290B: axial hole
300: metallic shell
310: front end portion
320: external thread portion
330: trunk portion
340: tool engagement portion
390: front hole
410: packing
420: ring
430: talc powder
440: ring
500: gasket
600: INCONEL

The invention claimed is:

1. An ignition plug comprising:

a center electrode extending from a front side to a rear side in an axial direction;

an insulator formed in a bottomed tubular shape and enclosing a front end of the center electrode; and a metallic shell formed in a tubular shape extending in the axial direction and holding the insulator in a state where the insulator projects to the front side, wherein a volume V1 of a portion of the insulator, which projects from the metallic shell to the front side, is equal to or greater than 45 $mm^3$, and an expression $0.18 \leq V2/V1 \leq 0.37$ is satisfied, where H is a length along which the insulator projects from the metallic shell to the front side in the axial direction, and V2 is a volume of another portion of the insulator, which projects from a front end of the insulator along a length H/2 in the axial direction.

2. The ignition plug according to claim 1, wherein an expression $0\ mm < X - Y \leq 1.0\ mm$ is satisfied, where X is an inner diameter of a front hole of the metallic shell and Y is an outer diameter of a part of the insulator which opposes the front hole.

3. The ignition plug according to claim 1, wherein the length H is equal to or less than 9.7 mm, the insulator includes:

a first outer diameter portion projecting from the metallic shell and having a first outer diameter; and a second outer diameter portion having a second outer diameter D smaller than the first outer diameter and forming the front side of the insulator with respect to the first outer diameter portion, and an expression $D/L \leq 0.75$ is satisfied, where L is a length of the second outer diameter portion in the axial direction.

4. The ignition plug according to claim 1, wherein the center electrode includes a portion having an outer diameter that is larger than the rear side of the center electrode in a range of the length H/2 in the axial direction starting from the front end of the insulator.

5. The ignition plug according to claim 1, wherein the insulator includes a portion in which an outer diameter thereof decreases toward the front side in a range of the length H/2 in the axial direction starting from the front end of the insulator.

6. An ignition device comprising:

the ignition plug according to claims 1; and a voltage application part that is configured to generate non-equilibrium plasma on a surface of the insulator by applying an AC voltage or multiple pulse voltages to the center electrode.

* * * * *